US006095019A

United States Patent [19]

Warheit et al.

[11] Patent Number: 6,095,019

[45] Date of Patent: Aug. 1, 2000

[54] LOCKING PLIER TOOL

[76] Inventors: William A. Warheit, 121 Iroquois Dr., Butler, Pa. 16001; Matthew W. Warheit, 133 Dodds Rd., Butler, Pa. 16002

[21] Appl. No.: 09/107,921

[22] Filed: Jun. 30, 1998

[51] Int. Cl.[7] ..... B25B 7/12

[52] U.S. Cl. ..... 81/370; 81/368

[58] Field of Search ..... 81/319, 367–383.5

[56] References Cited

U.S. PATENT DOCUMENTS

| | | | |
|---|---|---|---|
| Re. 32,614 | 3/1988 | Wilson . | |
| D. 358,746 | 5/1995 | Neff . | |
| 2,420,020 | 5/1947 | Snell . | |
| 2,428,949 | 10/1947 | Ward et al. | 81/367 |
| 2,531,285 | 11/1950 | Manspeaker | 81/379 |
| 2,553,400 | 5/1951 | Blair . | |
| 2,661,648 | 12/1953 | Jones | 81/368 |
| 3,104,571 | 9/1963 | Trybus . | |
| 3,116,656 | 1/1964 | Hostetter | 81/379 |
| 3,195,382 | 7/1965 | Rommel et al. . | |
| 3,354,759 | 11/1967 | Cook | 81/370 |
| 3,376,766 | 4/1968 | Vienat . | |
| 3,379,079 | 4/1968 | Cutter . | |
| 3,496,808 | 2/1970 | Schmidt . | |
| 3,600,986 | 8/1971 | Baldwin, Jr. | 81/370 |
| 3,657,948 | 4/1972 | Myers . | |
| 3,673,896 | 7/1972 | Vardaman . | |
| 3,793,914 | 2/1974 | Helms | 81/378 |
| 3,878,741 | 4/1975 | Wilson . | |
| 5,435,214 | 7/1995 | Sisson . | |

*Primary Examiner*—James G. Smith
*Assistant Examiner*—David B. Thomas
*Attorney, Agent, or Firm*—George C. Atwell

[57] ABSTRACT

A locking plier tool, for clamping onto a workpiece of any size within the expanse of the tool's open jaws, has a thumb-actuated control member on the tool body and a release lever which facilitate, respectively, workpiece pressure adjustment and tool release by one hand of the operator manipulating the tool. A semiautomatic means for adjusting the tool's clamping pressure is also disclosed.

20 Claims, 5 Drawing Sheets

LOCKING PLIER TOOL

BACKGROUND OF THE INVENTION

This invention relates generally to a plier tool for applying a locked gripping force on a workpiece positioned between the opposed jaws of the tool. More particularly, this invention pertains to a locking plier tool capable of gripping and locking onto a workpiece and maintaining its gripping force on the workpiece until intentionally manually released. The tool is manually operated by one hand of the operator and manually adjustable by the same hand to change the clamping pressure exerted by the tool.

The prior art has provided a number of different types of adjustable locking pliers or wrenches where the pressure exerted by the jaws on the workpiece is selectively adjustable. Adjustment is usually accomplished by manually rotating a threaded shaft. Typically, it is necessary for the operator to hold the tool in one hand while using his other hand to manipulate the adjusting mechanism and then test the gripping action of the tool on the workpiece to determine if the desired pressure intensity or gripping force has been reached.

There remains a definite need for a locking plier tool capable of one-handed operation wherein the jaws of the tool can be clamped onto a workpiece and locked in position while the operator's other hand remains free, and being adjustable as to the jaw pressure exerted on the workpiece by the same hand holding the tool, and then being capable of release from the workpiece while the operator's other hand still remains free.

Typical of a locking plier tool in the prior art which provides means for varying the gripping pressure between opposed jaws is the tool disclosed in U.S. Pat. No. 3,600,986. This tool enables variance of the tool's jaw pressure by rotation of a threaded shaft and purports to provide a quick release lever. The tool, however, is incapable of being adjusted by the same hand used to close the handles and can only be released from the workpiece as a two-handed operation.

SUMMARY OF THE INVENTION

The present invention employs as its operating principle a sliding wedge means which, through appropriate linkage, determines the pressure exerted by the opposed jaws on the workpiece by the position of the sliding wedge means along the major handle frame assembly of the tool. The sliding wedge means is disposed to be advanced or retracted longitudinally relative to the major handle frame assembly by a thumb-controlled device which enables manual positioning of the wedge means to thereby increase or decrease the jaw pressure. The design of the tool is such that the operator, with only one hand, can regulate the gripping pressure.

The tool of the present invention may be provided with additional adjustment means enabling the pressure setting to be predetermined in accordance with use of the tool for successively gripping workpieces with the same gripping pressure. An alternative embodiment of the tool provides a semiautomatic adjustment mechanism wherein maximum jaw pressure is automatically predetermined as the tool is applied to a workpiece.

Other features and benefits of the tool of the present invention will become apparent from the ensuing detailed description.

DETAILED DESCRIPTION OF THE PREFERRED EMBODIMENT

Figure 2:
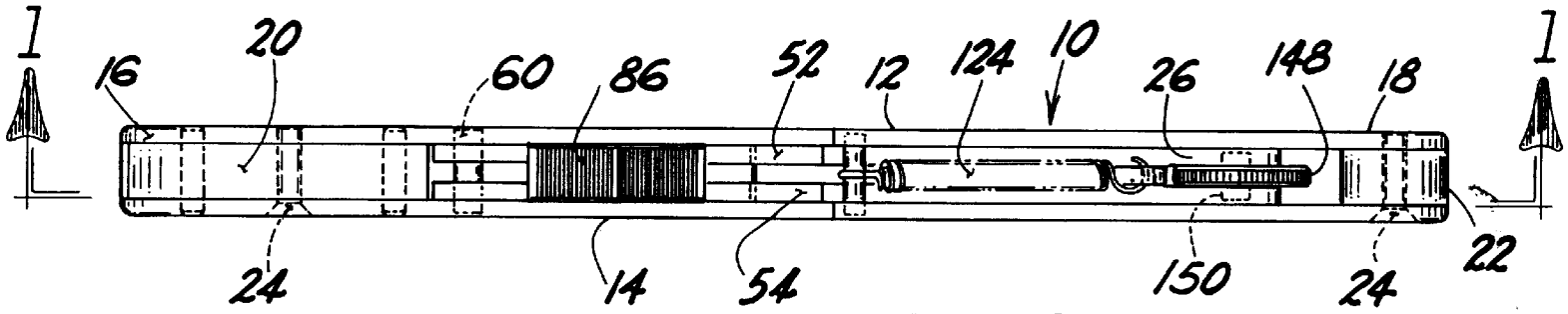
FIG. 2 is a top elevational view of the tool first shown in FIG. 1, with all of the structural components of the tool in place.
Figure 1:
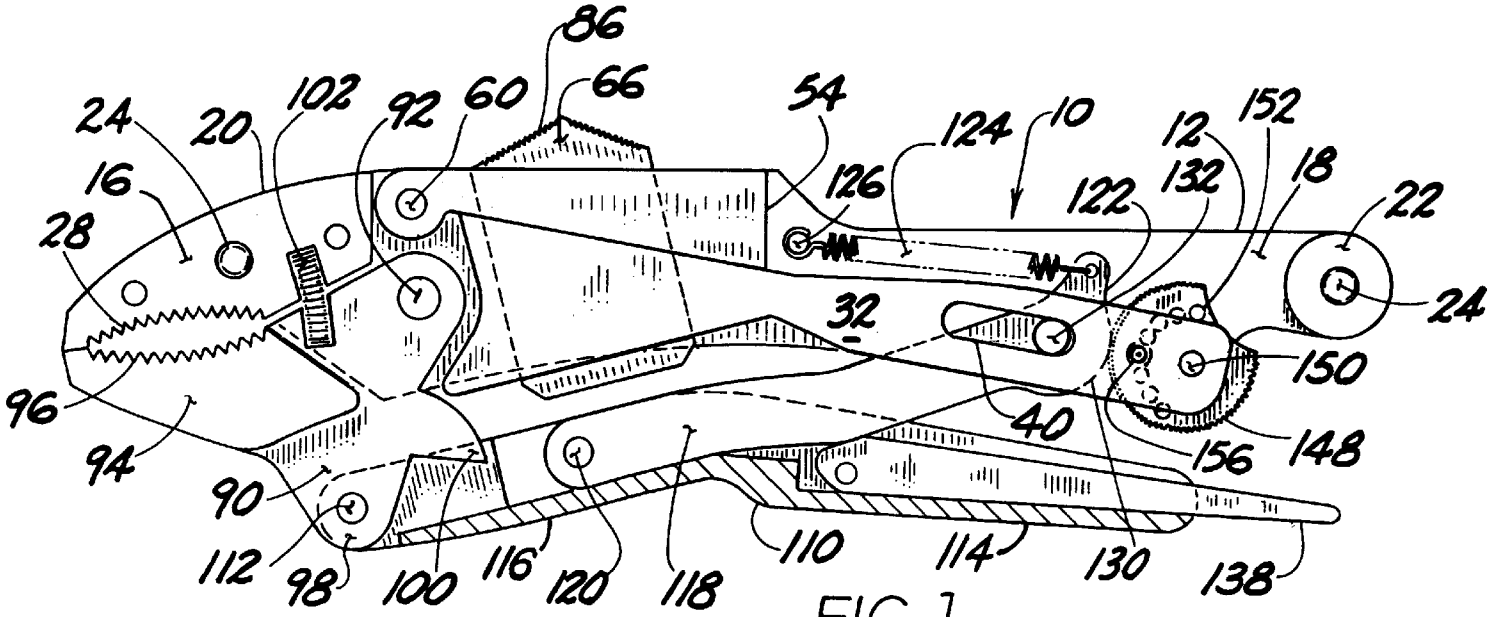
FIG. 1 is a side elevational view of the plier tool of the present invention having certain structural components cut away to reveal the internal structure of the tool.
Figure 3:
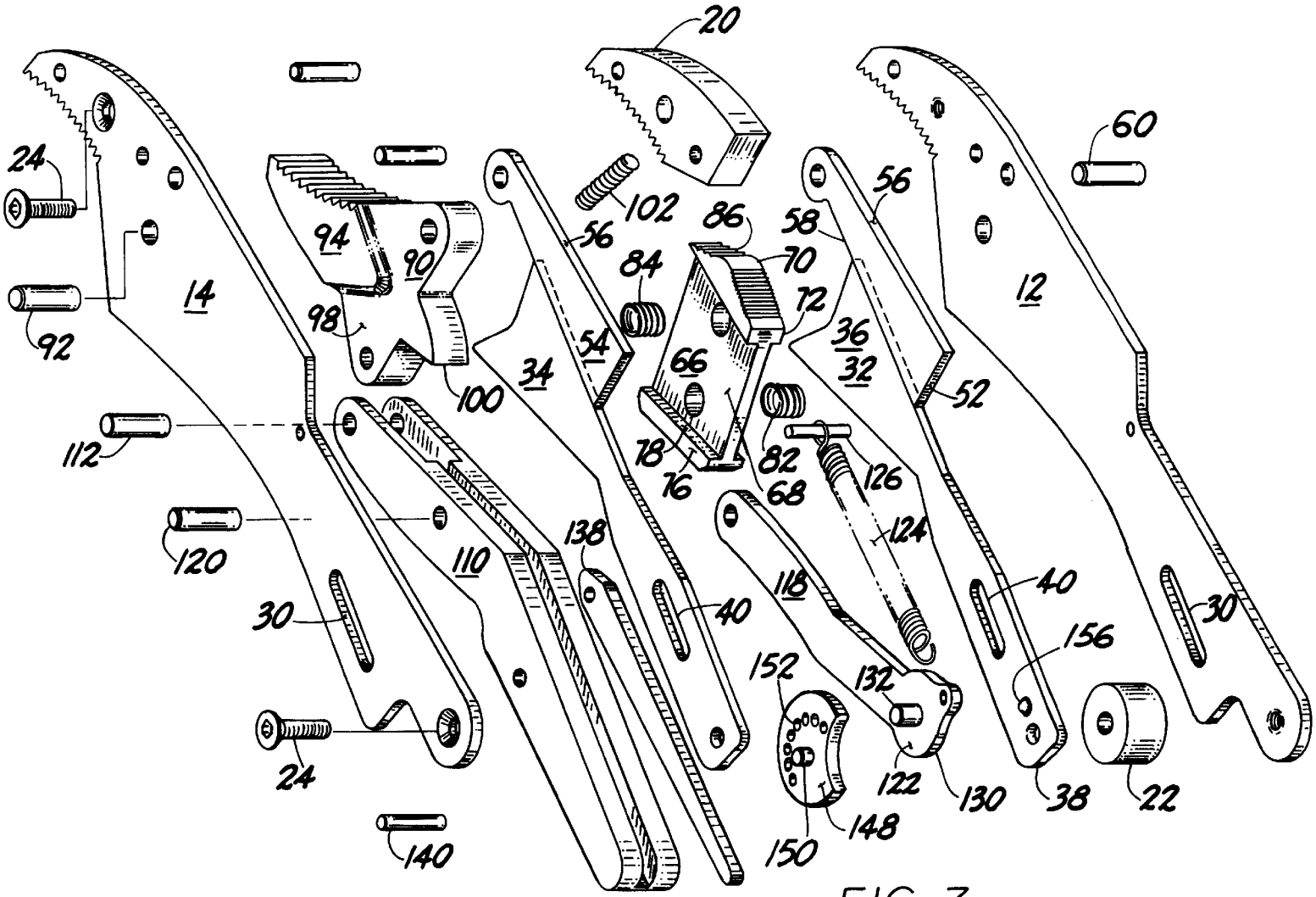
FIG. 3 is an exploded view of the plier tool of the present invention.

Referring first to FIGS. 1–3, the disclosed locking plier tool comprises a major handle frame assembly 10 having spaced-apart, parallel, rigid plate members 12 and 14. The assembly 10 has a jaw end 16 and a distal or handle end 18. The plate members 12 and 14 are joined by a jaw insert 20 at the jaw end 16 and a cylindrical spacer 22 at the distal end 18. Appropriate transverse fasteners 24 are utilized to fasten the plate members 12 and 14 in position.

As shown in FIG. 2, the plate members 12 and 14 are disposed to provide a space 26 which extends substantially the full length of the major handle assembly. At the front or jaw end 16, the jaw insert 20 is provided with gripping teeth 28, and adjacent the distal end of the assembly, longitudinal slots 30 are provided in aligned disposition in the plate members 12 and 14.

Figure 8:
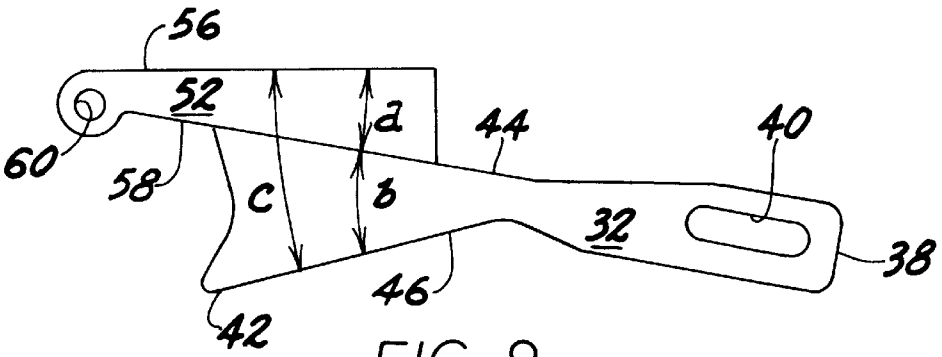
FIG. 8 is a side elevational view of certain components of the tool of the present invention, illustrating certain angularity relationships of the illustrated components.

Mounted between the plate members 12 and 14 is a wedge means including a pair of elongated, rigid, slidable wedge embers 32 and 34. Each wedge member 32 and 34 has a wide forward end 36 and a distal end 38 (FIG. 8). The wedge members 32 and 34 also have respective elongated slots 40 adjacent their respective distal ends 38 and aligned relative to each other. The forward end of each wedge member 32 and 34 has a downwardly-projecting tongue portion 42, an upper forward edge 44, and a lower forward edge 46. As shown in FIG. 1, a pair of spaced-apart, fixed lever or guide plates 52 and 54 are disposed between the plate members 12 and 14. Each of the guide plates 52 and 54 has an upper straight edge 56 and a lower edge 58. The guide plates 52 and 54 are held in their mounted position by a fastener 60 extending from plate member 12 to plate member 14.

Figure 6:
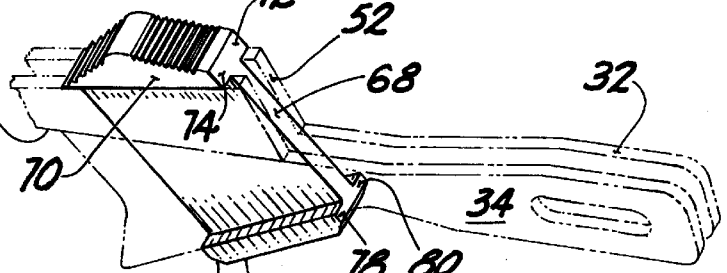
FIG. 6 is a perspective view of certain components of the tool of the present invention, consistent with the illustration set forth in FIG. 5.

The major handle assembly includes a slidable means in the form of a slidable adjuster or control member 66 which is a rigid member resembling, in vertical cross-section, an I-beam (see FIG. 6). The control member 66 has a central body portion 68, an upper end 70, and a downward end 76. The upper end 70 has lateral, oppositely-projecting flange portions 72 and 74, and the downward end 76 has oppositely-projecting lateral flange portions 78 and 80. Suitable openings are provided through the central body portion 68 of the control member 66 to contain small compression springs 82 and 84. The upper end of the control member 66 projects outwardly on the major handle assembly 10 and has a ridged contact surface 86 to facilitate manual thumb manipulation of the control member as will be hereafter described in greater detail.

Figure 4:
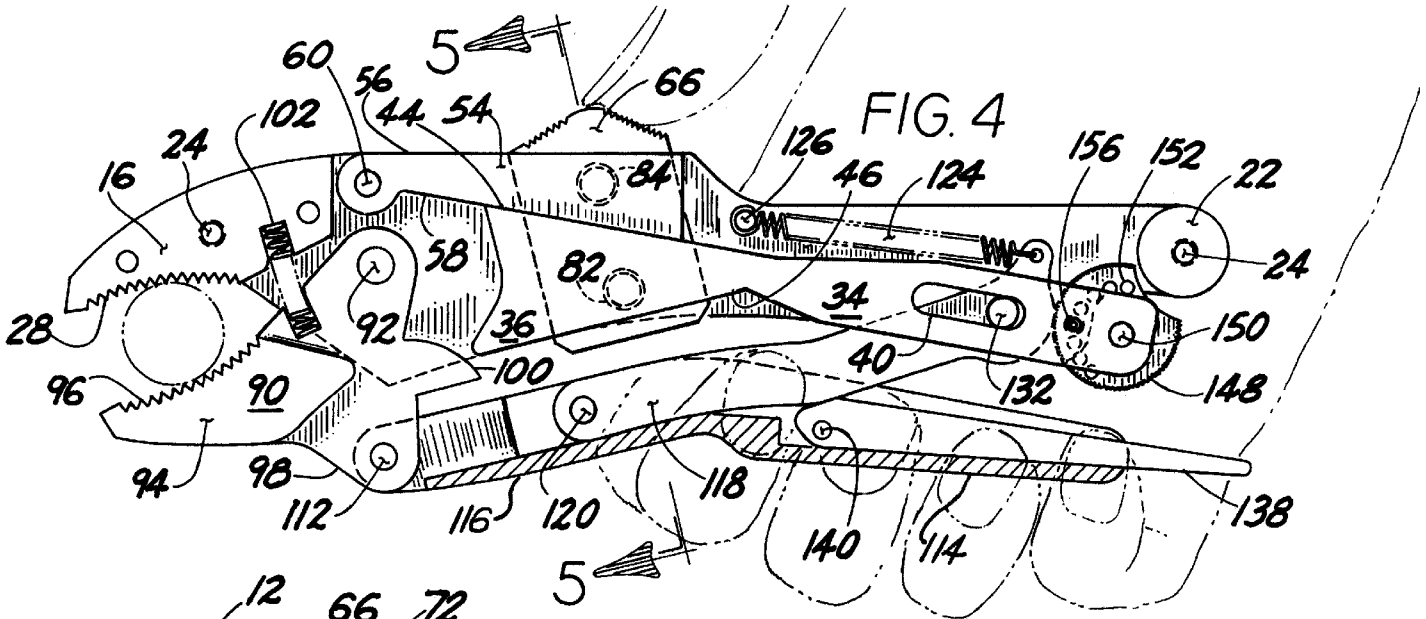
FIG. 4 is a side elevational view of the plier tool, similar to FIG. 1, but showing certain components of the tool repositioned in accordance with the tool's operation.
Figure 7:
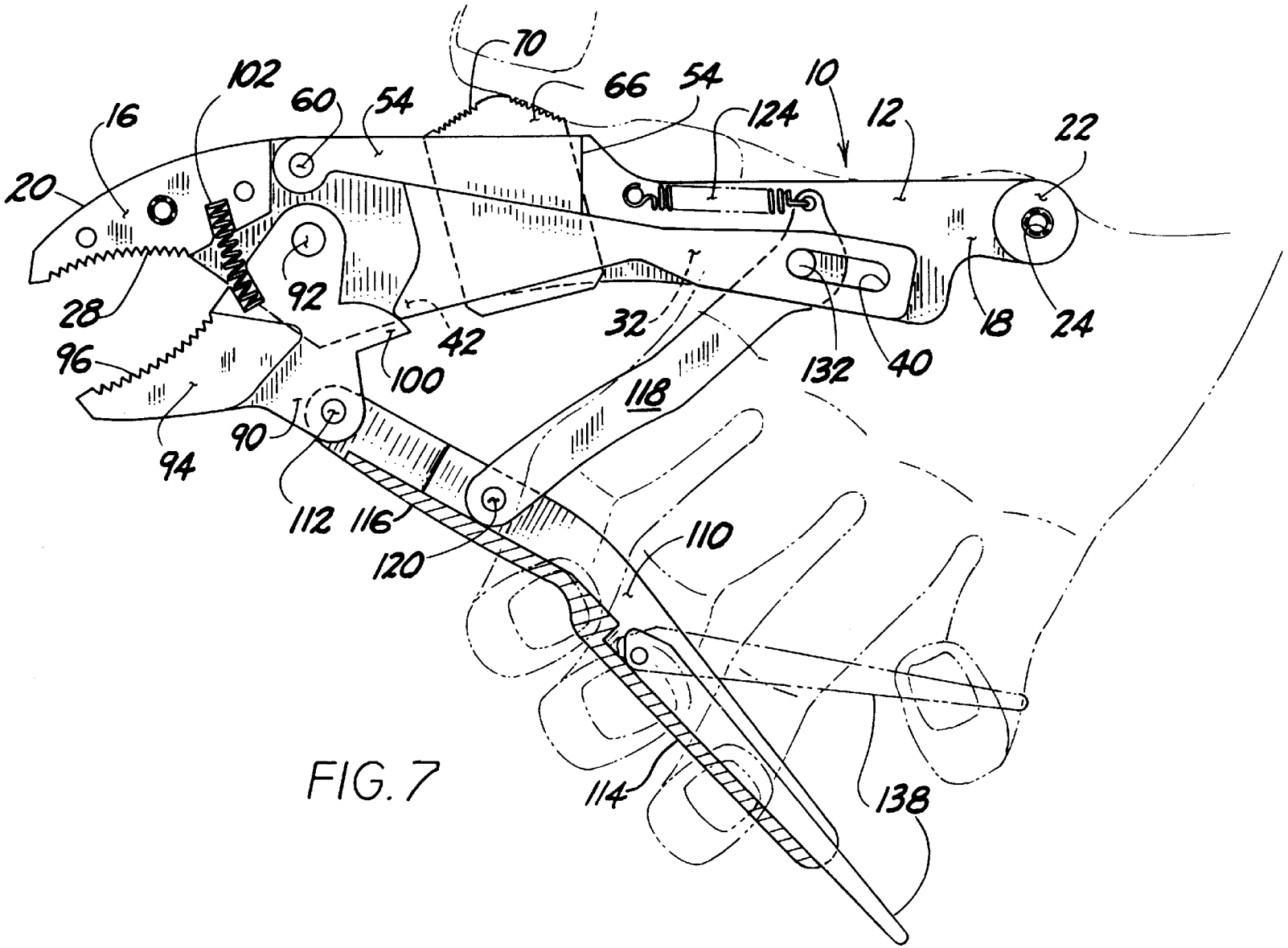
FIG. 7 is a side elevational view of the tool of the present invention, similar to FIGS. 1 and 4, except illustrating the tool in its fully open position prior to gripping a workpiece.

The plier tool of the present invention further includes a pivotable jaw plate 90 which pivots on a post 92 and presents a widened forward jaw portion 94 as best shown in FIGS. 1, 4, and 7. The jaw portion 94 is provided with a series of teeth 96 which operate in opposition to the teeth 28 on the jaw insert 20 of the major handle assembly 10. As shown in FIG. 1, the jaw plate 90 has a downwardly-projecting portion 98 and a rearwardly-projecting arcuate portion 100. The jaw plate 90 is appropriately slotted to contain one end of a biasing means, preferably a compression spring 102 which projects upwardly into an appropriate slot in the jaw insert 20.

Connected to the pivotal jaw plate 90 is a rearwardly-extending handle 110 having a forward end 116 and a distal end 114, and extending from an intermediate point on the handle 110 to the major handle assembly 10 is a rigid linking plate or member 118. The forward end of the handle member 110 is pivotally connected to a downwardly-projecting portion 98 of the jaw plate 90 by means of a transverse pivot post 112, and the link member 118 is pivotally connected to the handle member by a transverse pivot post 120. The end of the link member 118, which projects toward the distal end of the major handle assembly 10, has a rear or distal end 122 which is slidably contained between the wedge members 32 and 34. A transverse pin 132 is firmly anchored in the end 122 of the link member 118 and projects bilaterally into the respective slots 40 provided in the wedge members 32 and 34. The linking member 118, at its rearward end, has an integral projecting finger portion 122 to which is attached a forwardly-projecting extension spring 124, the forward end of which is fixed at a pin 126. The link member 118, further, has an arcuate camming edge 130 designed to operate in conjunction with an adjusting dial 148 which is eccentrically mounted to rotate between the distal ends of the spaced-apart wedge members 32 and 34. Projecting rearwardly from the pivotal handle 118 and contained substantially within the handle structure is a release lever 138, the use of which will be described in conjunction with the ensuing description of the tool's operation.

The use of the tool of the present invention begins with the operator gripping the tool substantially as shown in FIG. 7 where the opposed jaws 16 and 94 are in their fully open position and the handle 110 is pivoted away from the major handle assembly 10. The tool is placed with the workpiece between the opposed jaws 16 and 94 and the handles are closed to cause the jaws to lightly grasp the workpiece. Then the operator, with the thumb of the same hand holding the tool, slides the control member 66 forward (to the left as viewed in FIG. 7) which causes the wedge means comprising wedge members 32 and 34, to slide slightly forwardly against the undersurface of the fixed guide plates 52 and 54.

The length of the slide pathway for control member 66 may be observed by comparing the position of control member 66 in FIG. 7 with its position as shown in FIG. 1. The size of the workpiece to be gripped and the gripping force the operator wishes to exert on the workpiece determines the distance which the operator will slide the control member 66 in a forward direction. The operator closes the jaws of the tool on the workpiece by manually closing the handle 110 toward the major handle frame assembly 10. FIG. 4 shows the tool of this invention in the fully closed position and gripping a workpiece with a relatively light clamping force because the control member 66 has not been slidably advanced from its starting or retracted position. When it is desired to release the tool from the workpiece, the operator performs such release by operation of the release means in the form of the lever 138. The lever 138 pivots from its normal coextensive position with the handle distal end 114 to the release position shown by phantom line in FIG. 7. The aforedescribed releasing action is accomplished by one finger of the same hand by which the operator is holding and operating the tool.

As shown in FIG. 8, each fixed guide plate 52 and 54 is inclined at its lower edge 58, in a direction opposite to the inclination of the mating upper edge 54 of the sliding wedge, 32 or 34, with which the fixed guide plate is associated. To enable the slidable wedge positioning adjustment to occur within the major handle frame assembly of the tool, certain preferred angular relationships have been empirically determined. The straight upper edge 56 of the guide plate 52 forms an angle "a" of ten degrees in relation to the lower straight edge 58. The lower straight edge 46 of the slidable wedge 32 forms an angle "c" within the range of twenty-two to twenty-four degrees, and preferably twenty-three degrees, relative to the upper straight edge 56 of the fixed guide plate 52. The lower edge 46 of the slidable wedge 32 forms an angle "b" between its upper edge 44 and the lower edge 58 of the fixed guide plate 52. The angle "b" is within the range of twenty-two to twenty-four degrees, and preferably twenty-three degrees.

Figure 5:
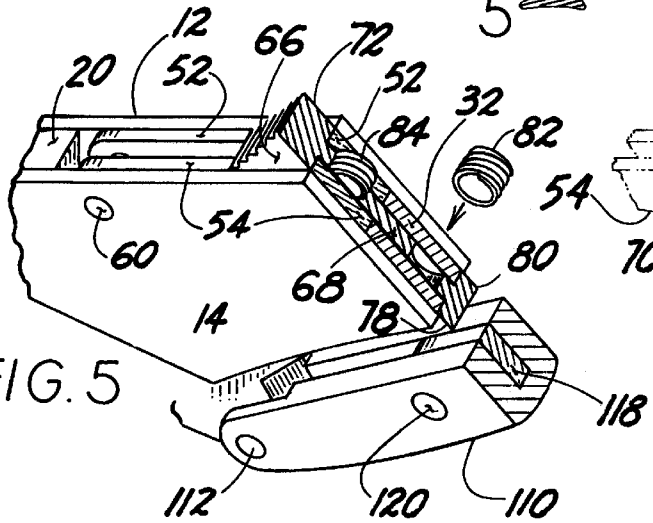
FIG. 5 is a perspective view taken along lines 5—5 of FIG. 4.

As best shown in FIGS. 5 and 6, the slide adjuster or control member 66 has a planar central body portion 68 which is contained between the pairs of fixed guide plates 52 and 54 and the slidable wedge members 32 and 34. At the end of the control member 66 which projects outwardly from the major handle assembly 10 for thumb manipulation, an integral widened portion is presented which provides oppositely-projecting lateral flanges 72 and 74. The lower end 76 of the control member 66 also has an integral widened portion presenting oppositely-projecting flange portions 76 and 80. The undersurface of the flange portion 70 is a flat surface which contacts and slides upon the upper straight edge 56 of the fixed plate 54, and the flange portion 72 has a flat undersurface which contacts and slides upon the straight upper edge 56 of the fixed guide plate 52. Similarly, the lower end of the control member 66 presents oppositely-projecting flange portions 78 and 80 having respective flat surfaces at right angles to the central body portion 66, which contact and slide, respectively, against the lower straight edges 46 of the slidable wedges 32 and 34. Accordingly, the flat surface on the underside of the lateral flange portion 74 forms an angle with the straight flat surface of the lateral flange portion 78, and the same angular relationship is established between the flat undersurface of the lateral flange portion 72 and the flat surface of the flange portion 80.

Considering now the pivotal handle 110 and its interconnected components, the pivotal jaw plate or member 90 forms, in combination with the link member 118 and the handle 110, an over-center mechanism. In using the tool to grasp a workpiece, the handle 110 is pulled by the operator's hand and is pivoted on pivot post 112, and the jaw member 90 is thereby pivoted on pivot post 92 whereby the jaw portion 94 moves toward jaw end 16. Exerting upward hand pressure against the handle 110, at the distal end 114 of the handle to the right of the link member connection (as viewed in FIG. 7), pivots the handle member 110 on pivot post 120 in a counterclockwise rotation. The forward end 116 of the handle member 110 is simultaneously forced downwardly at its connection by pivot post 112 to the member 90 whereby the member 90 is caused to pivot on pivot post 92 in a clockwise direction.

In closing the tool on a workpiece, the biasing force normally exerted by spring 102 and spring 124 must be overcome, and this is easily accomplished by the hand of the operator drawing the handle 110 toward the major handle frame assembly 10. The spring 102 normally urges the tool's jaws to move away from each other toward their fully open position and this action is assisted by the pulling force exerted by spring 124 attached to the back end 122 of link member 118. One of the springs 102 or 124 can be eliminated from the mechanism without greatly detracting from the tool's operation but the action of both springs tends to provide a more balanced opening action when the operator of the tool institutes release of the tool from the workpiece. The operator uses one finger to draw the release lever 138 from its normal longitudinally-extending position on the handle 110 to the release position as shown in FIG. 7.

The aligned slots 40 which are provided adjacent the distal ends of the wedges 32 and 34 constitute a load-bearing point where the link member 118 has its end 122 secured between the wedges 32 and 34 by means of a crosspin 132 fixed in an opening in the link member 118 and extending bilaterally into the slots 40. It is the combination of the slots 40 in the sliding wedges 32 and 34 and the interaction therewith of the end 122 of the linking member 118 that correlates the sliding wedge movement with the rotation of the pivotal jaw.

The control member or adjuster 66 is adapted to slide longitudinally on the major handle frame assembly 10 in response to motion imparted to it by the operator's thumb. The adjuster 66 will move the wedge members 32 and 34 in unison between a full forward position toward the jaw end and a rearward position away from the jaw end. Hence, thumb-controlled adjustment, which establishes both the size of the jaw opening for a workpiece grasped between the jaws and the desired pressure to be exerted on the workpiece, is infinitely variable within the sliding range of the adjuster 66 between its forward and rearward positions.

An advantageous feature of the disclosed tool is that the angular relationship of the handle 110 to the major handle frame assembly 10, when the tool is in the fully open position, is maintained within the gripping range of the operator's hand so that one-handed operation of the tool can be accomplished. The widest expanse between the distal end 114 of handle 110 and the major handle frame assembly 10 is determined by the interaction of the tongue portion 42 of the slidable wedge 32 against the tooth portion 100 of the pivotal jaw member 90.

With benefit of the disclosure of the tool of this invention, any person skilled in the art should readily appreciate that the fixed guide plates 52 and 54 could be a unitized structure and that the slidable wedges 32 and 34 could be a single member. Then, the slidable control member 66 would necessarily be configured to surround the interacting unitized guide plate and slidable wedge.

Figure 10:
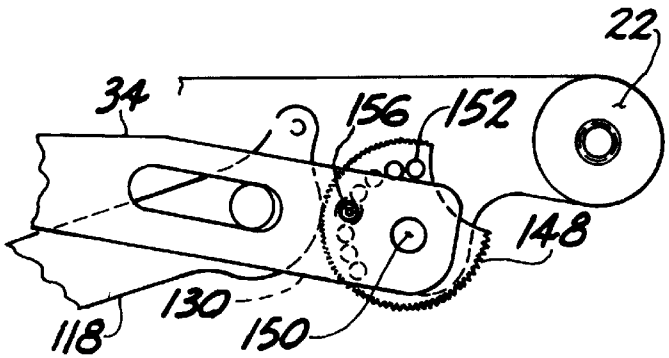
FIG. 10 is a side elevational view of certain components of the tool of the present invention, illustrating in greater detail a control means for the tool.

An optional secondary manual control means is presented (FIG. 1–4 and 10) in the form of a rotatable notched dial 148 eccentrically mounted on an axis pin 150 whereby the dial 148 is secured between the spaced-apart slidable wedge members 32 and 34. Where it is desired to preset the tool to a predetermined jaw clamping pressure, rotation of the dial 148 exerts a camming action against surface 130 of the link 118. By thus causing the end 122 (FIG. 1) of the link member 118 to be disposed slightly forward relative to the major handle frame assembly, the point at which the over-center linkage will be activated is advanced from normal such that a predetermined clamping pressure between the opposed jaws can be established for repetitive use of the tool on successive workpieces. As shown in FIG. 10, the notched dial 148 is rotatably mounted on post 150 between the slidable wedges 32 and 34. One flat surface of the dial 148 is provided with a curved track 152 comprising a series of ridge-separated recesses which will interact with an inwardly-projecting dimple 156 in the slidable wedge 34 to prevent inadvertent unintentional dial rotation.

Figure 9:
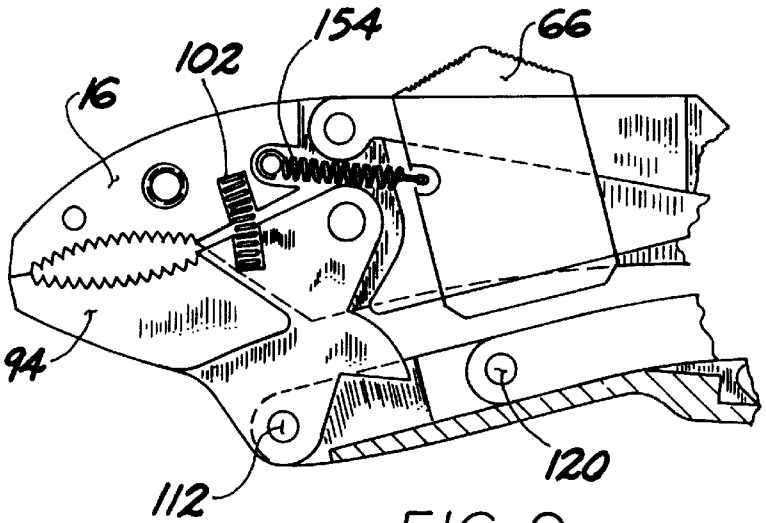
FIG. 9 is a partial side elevational view of the tool of the present invention, illustrating a means of alternatively providing the tool with an automatic operational function.

FIG. 9 illustrates a means by which the tool of the present invention may be rendered semiautomatic in operation. A biasing means or extension spring 154 may be provided to extend between the jaw member 16 and the central body portion of the control member 66. The spring 154 will normally urge the control member 66 forwardly toward the jaw end of the tool. By this arrangement, the control member 66 may be retracted rearwardly by the thumb of the operator, but when the tool is brought into position on a workpiece, the control member 66 and the associated slidable wedges 32 and 34 will be in their full forward position when the tool's jaws are closed on a workpiece, thereby assuring that full pressure capability of the tool will be applied to the workpiece.

The invention heretofore described is a presently preferred embodiment with certain structural variations, but it should be observed that other modifications and alternate constructions of the disclosed tool can be made without departing from the scope and spirit of the invention as established by the breadth of the appended claims.

What is claimed is:

1. A plier tool capable of releasably locking opposed jaws onto a workpiece by a manual one-handed operation, comprising, in combination:

a primary lever assembly having:

spaced-apart, elongated rigid sidewalls disposed in generally parallel relation to each other to provide a forward jaw end and a rearward distal end;

an elongated fixed wedge mounted between the sidewalls and extending toward the distal end and having a forward end adjacent the jaw end;

a rigid, elongated, slidable wedge mounted between the sidewalls to slide in contact with the fixed wedge;

a manually-slidable adjusting means disposed in contact with both the fixed wedge and the slidable wedge for slidably advancing or retracting the slidable wedge along the fixed wedge; and a secondary lever assembly having:

a pivotal jaw member mounted to pivot on the primary lever assembly at a point adjacent the jaw end;

an elongated handle member having a forward end pivotally connected to the pivotal jaw member whereby it may be manually pivoted relative to the primary lever assembly, and a rear handle end;

a rigid link member having a first end pivotally connected to the handle member at an intermediate point thereon, and a second end movably secured to the slidable wedge whereby sliding advancement or retraction of the slidable wedge is translated to the link member.

2. The plier tool of claim 1, further including biasing means normally urging the adjusting means to advance the slidable wedge along the fixed wedge.

3. The plier tool of claim 1 wherein the fixed wedge has an outside straight edge generally parallel to an adjacent straight sidewall edge, and an opposite straight edge forming a ten degree angle with the outside straight edge.

4. The plier tool of claim 3 wherein the slidable wedge has a first long edge disposed to slide along the opposite straight edge of the fixed wedge, and a second long edge of the slidable wedge forms an angle in the range of twelve degrees to fourteen degrees in relations to the outside straight edge.

5. A plier tool comprising:

a major handle assembly having a fixed forward jaw and a slidable wedge adapted to slide in a path to and away from the fixed jaw, and an adjuster member for manually sliding the slidable wedge;

a pivotal jaw member in opposed relation to the fixed jaw and being pivotal at a point on the major handle assembly;

a secondary handle interconnected to the pivotal jaw whereby manual closing of the secondary handle toward the major handle assembly causes the pivotal jaw to swing toward the fixed jaw; and a rigid linking member extending between the secondary handle and the sliding wedge whereby manipulation of the adjuster is translated to the linking member and thence to the pivotal jaw member to enable manual sensing of the size of a workpiece to be gripped between the fixed jaw and the pivotal jaw and to establish the gripping force to be exerted by the jaws on the workpiece.

6. The plier tool of claim 5 wherein the adjuster member is adapted to slide the slidable wedge longitudinally on the major handle assembly between a full forward position and a rearward position whereby positional adjustment of the slidable wedge is infinitely variable within its sliding range.

7. A locking plier tool for exerting a clamping pressure on a workpiece, comprising:

an elongated major handle frame assembly having a jaw end and an opposite distal end;

a pivotal jaw member pivotally attached to the frame assembly and in opposed position to the jaw end;

a handle member pivotally secured to the pivotal jaw member;

wedge means slidably mounted on the frame assembly for generally longitudinal sliding movement within the frame assembly;

the wedge means operatively interconnected to the pivotal jaw member and the handle member;

slidable means on the frame assembly for slidably advancing the wedge means toward the jaw end whereby the position of the sliding member along the length of the frame assembly determines the clamping pressure between the jaw end and the pivotal jaw; and the slidable means having a body portion extending through the wedge means and a portion thereof projecting from the frame assembly for manually causing the wedge means to slide relative to the jaw end.

8. A locking plier tool for exerting a clamping pressure on a workpiece, comprising:

an elongated major handle frame assembly having a jaw end and an opposite distal end;

a pivotal jaw member pivotally attached to the frame assembly and in opposed position to the jaw end;

a handle member pivotally secured to the pivotal jaw member;

wedge means slidably mounted on the frame assembly for generally longitudinal sliding movement within the frame assembly;

the wedge means operatively interconnected to the pivotal jaw member and the handle member;

slidable means on the frame assembly for slidably advancing the wedge means toward the jaw end whereby the position of the sliding member along the length of the frame assembly determines the clamping pressure between the jaw end and the pivotal jaw;

the slidable means having a body portion extending through the wedge means and a portion thereof projecting from the frame assembly for manually causing the wedge means to slide relative to the jaw end; and means extending between the jaw end and the pivotal jaw member and acting to normally bias the pivotal jaw member away from the jaw end.

9. A locking plier tool for exerting a clamping pressure on a workpiece, comprising:

an elongated major handle frame assembly having a jaw end and an opposite distal end;

a pivotal jaw member pivotally attached to the frame assembly and in opposed position to the jaw end;

a handle member pivotally secured to the pivotal jaw member;

wedge means slidably mounted on the frame assembly for generally longitudinal sliding movement within the frame assembly;

the wedge means operatively interconnected to the pivotal jaw member and the handle member;

slidable means on the frame assembly for slidably advancing the wedge means toward the jaw end whereby the position of the sliding member along the length of the frame assembly determines the clamping pressure between the jaw end and the pivotal jaw; and means mounted at the distal end of the wedge means for manually advancing the wedge means toward the jaw end prior to use of the tool.

10. The locking plier tool of claim 9 further comprising biasing means normally urging the slidable means toward the jaw end of the frame assembly.

11. A locking plier tool for clamping a workpiece between opposed jaws, comprising:

an elongated major handle member having a first end terminating in a first of the opposed jaws and a second end being a handle portion;

wedge means mounted and extending longitudinally on the major handle member;

wedge control means including a body portion extending into the wedge means and a portion projecting outwardly from the major handle member for manually advancing the wedge means toward the opposed jaws; and linkage means extending from the wedge means to the second of the opposed jaws whereby advancement of the wedge means toward the opposed jaws acts to close the opposed jaws toward each other.

12. The locking plier tool of claim 11 wherein the wedge means is a pair of spaced-apart wedge plates adapted to slide in unison along the major handle member.

13. The locking plier tool of claim 11 wherein the wedge control means is a slidable member having a portion thereof disposed between the wedge plates.

14. The locking plier tool of claim 11 further comprising manually adjustable means adjacent the distal end of the major handle member for establishing a predetermined gripping pressure for the opposed jaws.

15. The locking plier tool of claim 11 wherein the manually adjustable means is a dial member eccentrically mounted to rotate on the wedge means.

16. The locking plier tool of claim 11 comprising a secondary handle member pivotally interconnected to the second opposed jaw for causing the opposed jaws to clamp on a workpiece.

17. The locking plier tool of claim 11 further comprising spring means acting to normally urge the opposed jaws toward their full open position.

18. The locking plier tool of claim 11 further comprising biasing means operatively associated with, and acting to arrest sliding action of, the slidable means.

19. The locking plier tool of claim 7 further comprising biasing means normally urging the slidable means toward the jaw end of the frame assembly.

20. A locking plier tool for exerting a clamping pressure on a workpiece, comprising:

an elongated major handle frame assembly having a jaw end and an opposite distal end;

a pivotal jaw member pivotally attached to the frame assembly and in opposed position to the jaw end;

a handle member pivotally secured to the pivotal jaw member;

wedge means mounted on the frame assembly, including a fixed wedge and a slidable wedge, for generally longitudinal sliding movement within the frame assembly;

the wedge means operatively interconnected to the pivotal jaw member and the handle member;

slidable means on the frame assembly for slidably advancing the slidable wedge toward the jaw end whereby the position of the sliding wedge along the length of the frame assembly determines the clamping pressure between the jaw end and the pivotal jaw; and lever means on the handle member and pivotal toward the distal end of the frame assembly for manually causing the handle member to pivot to an open position relative to the frame assembly.

* * * * *